US005949451A

United States Patent [19]

Takagi

[11] Patent Number: 5,949,451

[45] Date of Patent: Sep. 7, 1999

[54] INK JET PRINTER

[75] Inventor: Jun Takagi, Ebina, Japan

[73] Assignee: Fuji Xerox Corporation, Ltd., Tokyo, Japan

[21] Appl. No.: 08/825,624

[22] Filed: Mar. 31, 1997

[30] Foreign Application Priority Data

Apr. 18, 1996 [JP] Japan ..... 8-097068

[51] Int. Cl.[6] ..... B41J 3/04; B41J 2/01; B41J 2/45

[52] U.S. Cl. ..... 347/40; 347/43

[58] Field of Search ..... 347/40, 43, 47, 347/9

[56] References Cited

FOREIGN PATENT DOCUMENTS 354048552 4/1979 Japan ..... 347/43

401234255 9/1989 Japan ..... 347/43

A-2-198850 8/1990 Japan .

A-4-353467 12/1992 Japan .

*Primary Examiner*—N. Le

*Assistant Examiner*—Lamson D. Nguyen

*Attorney, Agent, or Firm*—Oliff & Berridge. PLC

[57] ABSTRACT

An ink jet printer comprises a plurality of print heads 23, 23' respectively communicating with interiors of mutually different ink tanks Tk, Ty, Tm, and Tc and each having an ink nozzle for ejecting ink accommodated in each of the ink tanks Tk, Ty, Tm, and Tc onto a printing surface, wherein the position of a distal end of the ink nozzle having a higher velocity of an ink droplet ejected from the distal end of the ink nozzle is disposed at a position apart farther from the printing surface than the position of a distal end of the ink nozzle having a lower velocity of the ink droplet, so as to reduce variations in a timing when the ink droplet ejected from each of the ink nozzles reaches the printing surface.

5 Claims, 13 Drawing Sheets

INK JET PRINTER

BACKGROUND OF THE INVENTION

The present invention relates to an ink jet printer, and more particularly to an ink jet printer having a plurality of print heads.

The following techniques are conventionally known as the ink jet printers of the aforementioned kind. Technique disclosed in (J01) the Unexamined Japanese Patent Application Publication No. Hei. 2-198850:

This publication shows a carriage on which at least two ink jet heads can be mounted. In its embodiment, a print head for ejecting ink of two or four colors is incorporated in one ink jet head.

Technique disclosed in (J02) the Unexamined Japanese Patent Application Publication No. Hei. 4-353467:

In this publication, a technique for increasing the density of black characters by setting the size of droplets of black ink to a large size.

Problem of (J01)

With the technique of (J01) described above, since the size and weight of the ink droplet vary for each color, there has been a problem in that color offset occurs in a case where the distance between the paper and the print head which ejects ink at the same timing is fixed.

Problem of (J02)

With the technique of (J02) described above, if the size of the ink droplet is enlarged with respect to the ink of the other color(s), the kinetic energy generally increases and the ink droplet ejection velocity increases by the portion in which the weight of the ink droplet increases. Accordingly, since the ink droplet ejection velocities of the black ink and the color ink do not coincide, there has been a problem in that color offset is liable to occur.

As another method, it is conceivable to increase the density of black characters by increasing the density of the dye of the black ink or changing the composition of a solvent. In this case, the ink droplet ejection velocity changes in many cases. Therefore, since the ink droplet ejection velocities of the black ink and the color ink do not coincide, there has been a problem in that color offset is liable to occur.

To prevent the color offset, it is necessary to optimize the printing timing, the drive voltage, the pulse width, values of resistance of heating elements, and the like.

As still another problem, there has been a drawback in that if the temperature of the print head rises, the size of the ink droplet becomes large, and the ink droplet ejection velocity also increases. In the past experience, a relationship that the portion of an increase in the ejection velocity=about +1%/°C. has been obtained. Accordingly, there has been a problem in that even if the printing timing is set in such a manner that the color offset becomes minimal at a certain temperature, the color offset becomes large with an increase in the temperature of the print head.

SUMMARY OF THE INVENTION

In view of the above-described circumstances (and as a result of study), the object of the present invention is stated in the following paragraph (O01).

(O01) To prevent the occurrence of color offset even in a case where a plurality of print heads with different ink droplet ejection velocities are used.

Next, a description will be given of the arrangement of the present invention devised to overcome the above-described problems, and constituent elements of the present invention are indicated by the reference numerals of constituent elements of the embodiments in parentheses so as to facilitate the correspondence with the constituent elements of the embodiments which will be described later. It should be noted that the reason for the fact that the present invention is described in correspondence with the reference numerals used in the embodiments which will be described later is to facilitate an understanding of the present invention, and should not be construed as limiting the scope of the present invention to the embodiments.

First Invention

To overcome the above-described problems, the ink jet printer in accordance with the first invention of this application is characterized by comprising the following requirements:

A plurality of print heads (23, 23') respectively communicate with interiors of mutually different ink tanks (Tk, Ty, Tm, and Tc) and each has an ink nozzle for ejecting ink accommodated in each of the ink tanks (Tk, Ty, Tm, and Tc) onto a printing surface.

The print heads (23, 23') are arranged such that the position of a distal end of the ink nozzle having a higher velocity of an ink droplet ejected from the distal end of the ink nozzle is disposed at a position spaced apart farther from the printing surface than the position of a distal end of the ink nozzle having a lower velocity of the ink droplet, so as to reduce variations in a timing when the ink droplet ejected from each of the ink nozzles reaches the printing surface.

Second Invention

In addition, the ink jet printer in accordance with the second invention of this application is characterized by comprising the following requirements:

A plurality of print heads (23, 23') respectively communicate with interiors of mutually different ink tanks (Tk, Ty, Tm, and Tc) and each has an ink nozzle for ejecting ink accommodated in each of the ink tanks (Tk, Ty, Tm, and Tc) onto a printing surface.

The print heads (23, 23') are arranged such that the ink nozzle of one of print heads (23, 23') which are adapted to effect printing in reciprocating strokes and are arranged in such a manner as to be mutually spaced apart in a reciprocating direction has a shorter time duration from the time an ink droplet is ejected until the ink droplet reaches a printing surface than the ink nozzle of another one of the print heads (23, 23').

A following one of the ink nozzles ejects the ink droplet after the lapse of a predetermined time lag from an ejection timing of a preceding one of the ink nozzles, such that the ink droplet, ejected from the ink nozzle of the print head (23, 23') which follows by being disposed on a backward side in a moving direction, impacts against an impact position of the ink droplet ejected from the ink nozzle of the print head (23, 23') which precedes by being disposed on a forward side in the moving direction, during the reciprocating movement.

An ink-ejection controlling device is arranged such that, in a case where the ink nozzle for which the time duration from the time the ink droplet is ejected until the ink droplet reaches the printing surface is set to be short precedes, the time lag is set to be shorter than in a case where that ink nozzle follows.

Operation of the First Invention

Next, a description will be given of the operation of the present invention which is provided with the above-described features.

In the ink jet printer in accordance with the first invention of this application provided with the above-described features, the plurality of print heads (23, 23') respectively communicate with interiors of the mutually different ink tanks (Tk, Ty, Tm, and Tc) and eject the ink accommodated in the respective ink tanks (Tk, Ty, Tm, and Tc) onto the printing surface.

As for the print heads (23, 23'), the position of the distal end of the ink nozzle having a higher velocity of an ink droplet ejected from the distal end of the ink nozzle is disposed at a position spaced apart farther from the printing surface than the position of the distal end of the ink nozzle having a lower velocity of the ink droplet. As the positions of the distal ends of the ink nozzles are thus arranged, it is possible to reduce variations in the timing when the ink droplet ejected from each of the ink nozzles reaches the printing surface.

Accordingly, it is possible to set the ejection timing of the ink droplet from each ink nozzle without taking into consideration the difference in the time duration until the ink droplet ejected from each ink nozzle reaches the printing surface, and without causing color offset of a printed image which is ascribable to variations in the timing when the ink droplet reaches the printing surface.

Operation of the Second Invention

In the ink jet printer in accordance with the second invention of this application provided with the above-described features, the ink nozzles of the print heads (23, 23') respectively communicate with interiors of the mutually different ink tanks (Tk, Ty, Tm, and Tc), and eject the ink accommodated in the respective ink tanks (Tk, Ty, Tm, and Tc) onto the printing surface.

In a case where the print heads (23, 23') effect printing in the reciprocating strokes, the ink nozzle disposed on the backward side in the moving direction (the ink nozzle which follows) ejects after the lapse of a predetermined time lag from an ejection timing of a preceding one of the ink nozzles.

The ink-ejection controlling device is arranged such that, where the print heads (23, 23') are arranged in such a manner as to be mutually spaced apart in the reciprocating direction, the print head (23, 23') for which the time duration from the time the ink droplet is ejected until the ink droplet reaches the printing surface is set to be short precedes, the aforementioned time lag is set to be shorter than in a case where that ink nozzle follows. Consequently, it is possible to reduce the positional offset during the reciprocating movement between the impact position of the ink droplet ejected from the ink nozzle of the print head (23, 23') which precedes in the reciprocating direction and the impact position of the ink droplet ejected from the ink nozzle of the print head (23, 23') which follows.

BRIEF DESCRIPTION OF THE DRAWINGS

FIGS. 6A to 6C are diagrams explaining an ink-channel forming member of the print head in the first embodiment, in which FIG. 6A is a top view, FIG. 6B is a cross-sectional view taken along line VIB—VIB of FIG. 6A, and FIG. 6C is a cross-sectional view taken along line VIC—VIC of FIG. 6A;

FIGS. 7A and 7B are diagrams explaining an ink-tank mounting member of the print head in the first embodiment, in which FIG. 7A is a front cross-sectional view, and FIG. 7B is a view (bottom view) taken in the direction of arrow VIIB in FIG. 7A;

DETAILED DESCRIPTION OF THE PREFERRED EMBODIMENTS

First Form of the First Invention

Figure 1:
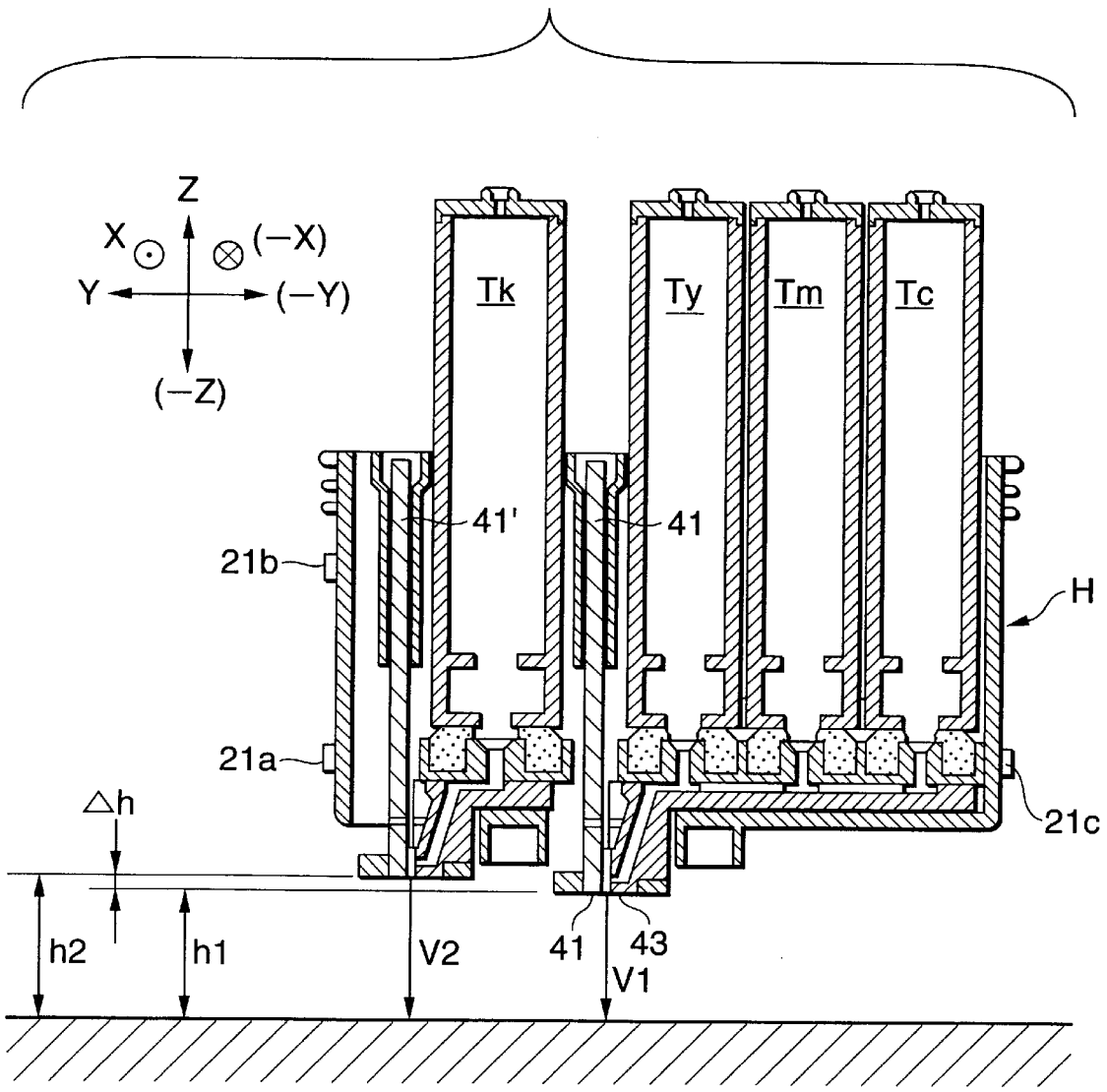
FIG. 1 is a schematic front cross-sectional view of a first embodiment of an ink jet printer in accordance with the present invention.

The first form of the ink jet printer in accordance with the first invention of this application is characterized by being provided with the following requirements in the above-described first invention:

Print heads (23, 23') have ink nozzles respectively communicating with the interiors of the ink tanks (Tk, Ty, Tm, and Tc) which accommodate black ink and color ink other than black.

The print heads (23, 23') are arranged such the ink droplet velocity of the black ink is higher than the ink droplet velocity of the color ink, and the black-ink ejecting nozzle is disposed in such a manner as to be spaced apart farther from the printing surface than the position of the color-ink ejecting nozzles.

Operation of the First Form of the First Invention

In the first form of the ink jet printer in accordance with the first invention of this application, the print heads (23, 23') have ink nozzles respectively communicating with the interiors of the ink tanks (Tk, Ty, Tm, and Tc) which accommodate black ink and color ink other than black. Since the black-ink ejecting nozzle has a higher ink droplet velocity than the ink droplet velocity of the color ink ejecting nozzles and is disposed in such a manner as to be spaced apart farther from the printing surface than the position of the color-ink ejecting nozzles. Thus, variations in the timing when the ink droplet ejected from each of the ink nozzles reaches the printing surface are reduced. Accordingly, it is possible to set the ejection timing of the ink droplet from each ink nozzle without taking into consideration the difference in the time duration from the time the ink droplets are ejected from the ink nozzle for black ink and the ink nozzles for color ink other than black ink until they reach the printing surface during the reciprocating strokes of the print heads (23, 23').

First Form of the Second Invention

The first form of the ink jet printer in accordance with the second invention of this application is characterized by being provided with the following requirement in the above-described second invention:

An ink-ejection controlling device is provided. If it is assumed that the (1); reciprocating velocity of two print heads (23, 23') spaced apart in the reciprocating direction is V, (2); the distance between the two print heads (23, 23') along the moving direction is L, (3); the distance from the distal end of the ink nozzle of one head chip to the printing surface is h1, (4); the velocity of the ink droplet ejected from the ink nozzle thereof is V1, (5); the distance from the distal end of the ink nozzle of another head chip to the printing surface is h2, and (6); the velocity of the ink droplet ejected from the ink nozzle thereof is V2, in a case where the one head chip precedes during the reciprocating movement, the time lag is set to be (L/V)+(h1/V1)−(h2/V2), whereas in a case where the other head chip precedes, the time lag is set to be (L/V)−(h1/V1)+(h2/V2).

Operation of the First Form of the Second Invention

In the first form of the ink jet printer in accordance with the second invention of this application, in the ink jet printer for effecting printing during the reciprocating strokes, it is possible to cause the ink droplets to impact at the same position on the printing surface irrespective of the positions of the ink nozzles of the print heads (23, 23') arranged to be mutually spaced apart in the reciprocating direction, as well as the ejection velocities of the ink droplets. The reason for this will be described in the embodiments.

Referring next to the drawings, a description will be given of examples of the forms (i.e., embodiments) of the ink jet printer in accordance with the present invention, but the present invention is not limited to the embodiments described below.

Incidentally, to facilitate an understanding of the following description, the X-axis, the Y-axis, and the Z-axis of the rectangular coordinate system are defined as the directions of arrows X, Y, and Z which are perpendicular to each other in the drawings, wherein the direction of arrow X is set as the forward direction, the direction of arrow Y is set as the leftward direction, and the direction of arrow Z is set as the upward direction. In this case, the opposite direction (−X-direction) to the X-direction (forward direction) is the backward direction, the opposite direction (−Y-direction) to the Y-direction (leftward direction) is the rightward direction, and the opposite direction (−Z-direction) to the Z-direction (upward direction) is the downward direction.

In addition, it is assumed that, in the drawings, the symbol with a dot (.) placed in a circle (○) means an arrow which is directed from the reverse side toward the obverse side of the plane of the drawing, while the symbol with a cross (X) placed in a circle (○) means an arrow which is directed from the obverse side toward the reverse side of the plane of the drawing.

First Embodiment

Figure 2:
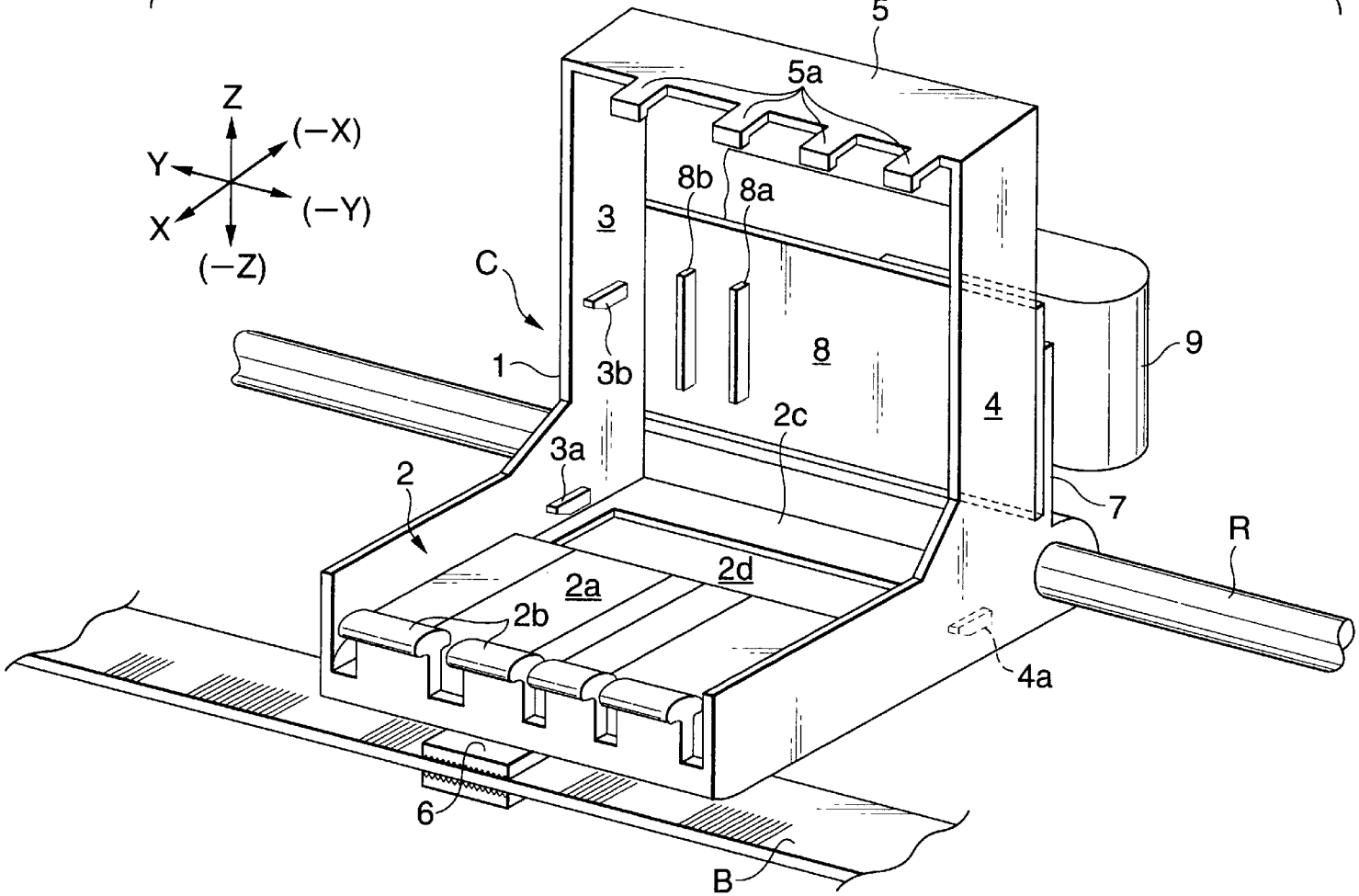
FIG. 2 is a perspective view of a head carriage for supporting and carrying a print head unit which is used in the first embodiment.
Figure 3:
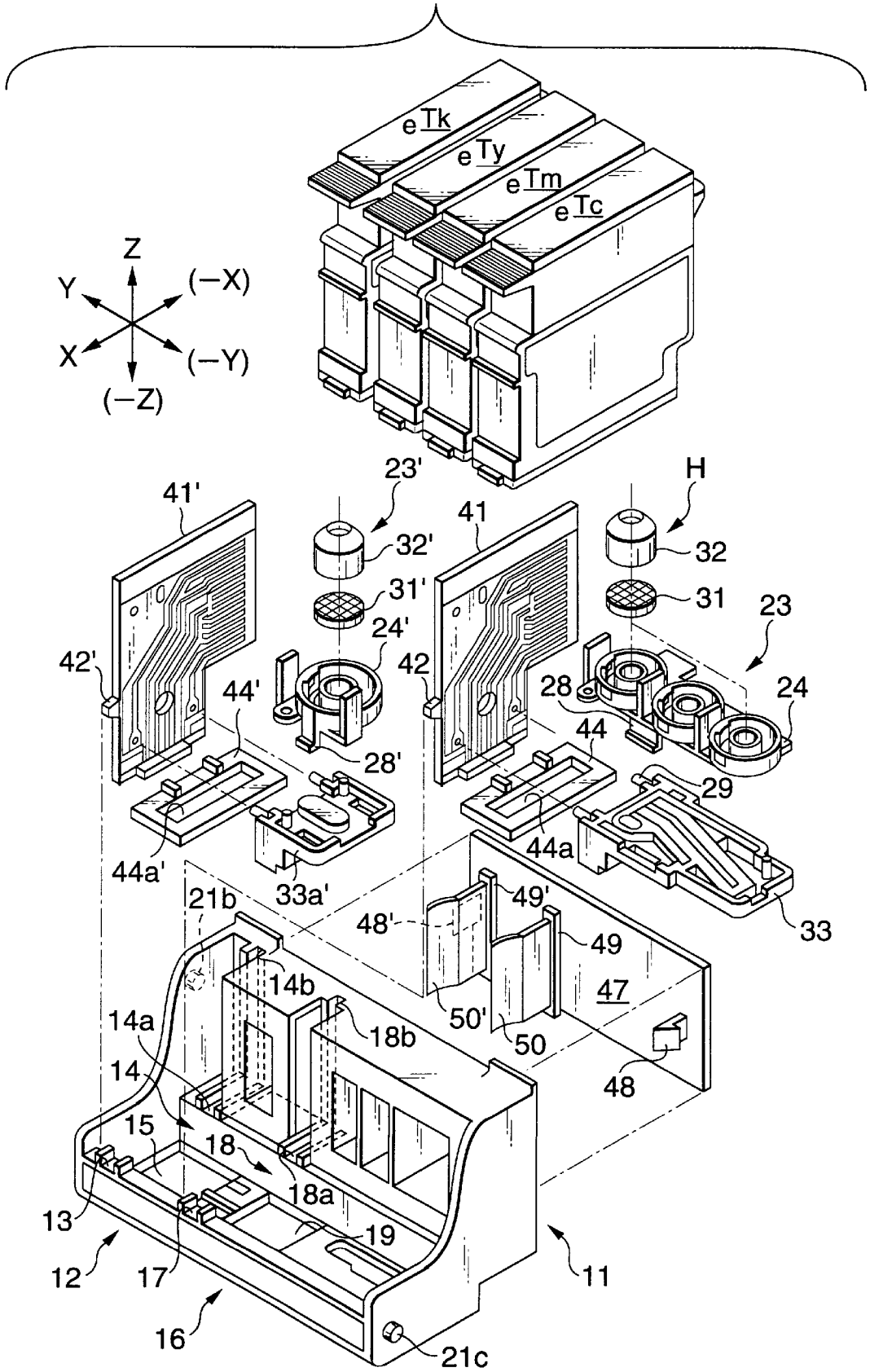
FIG. 3 is an exploded perspective view of the print head unit of the first embodiment.
Figure 4:
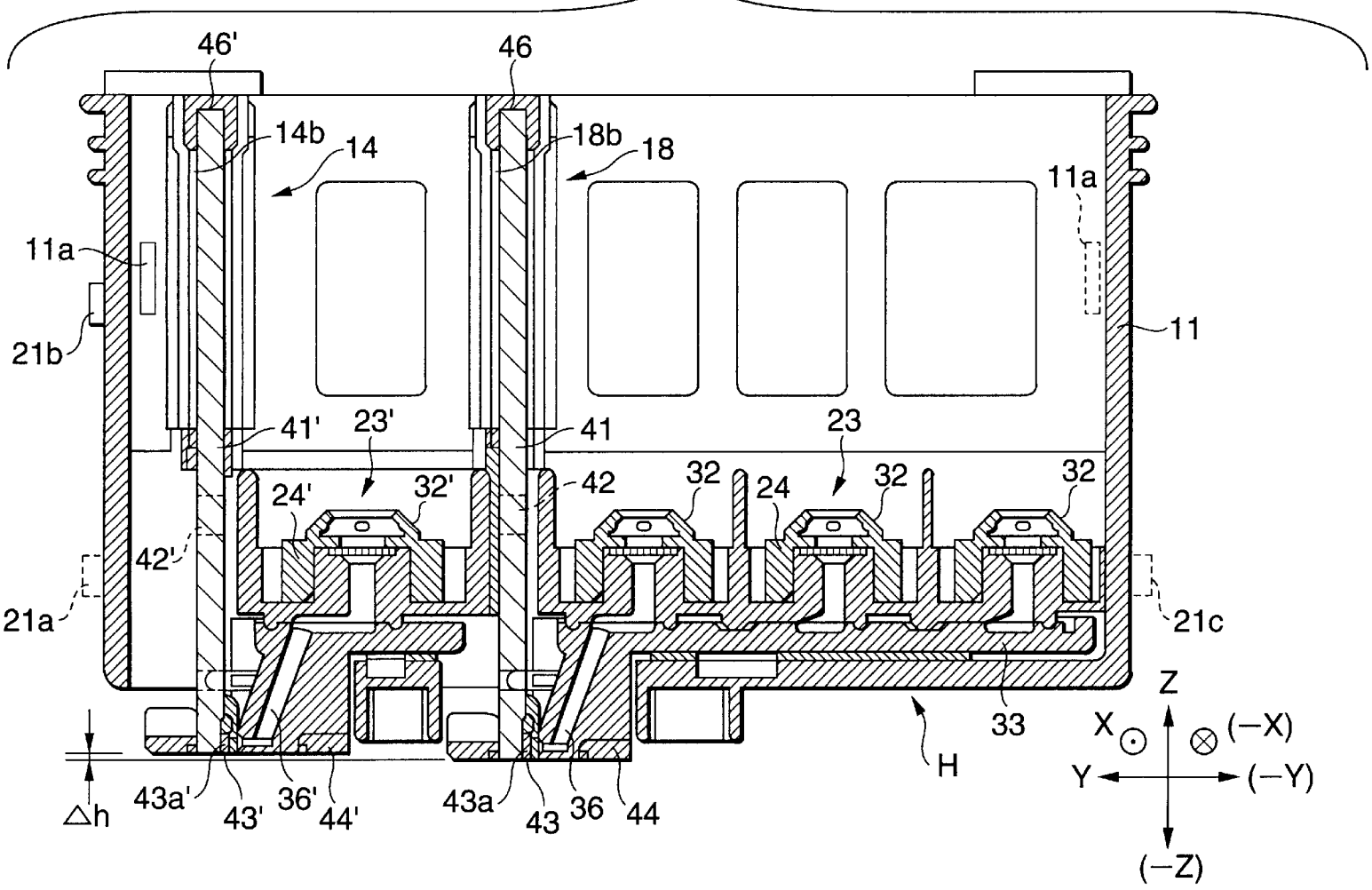
FIG. 4 is a front cross-sectional view of the print head unit in the first embodiment.
Figure 5:
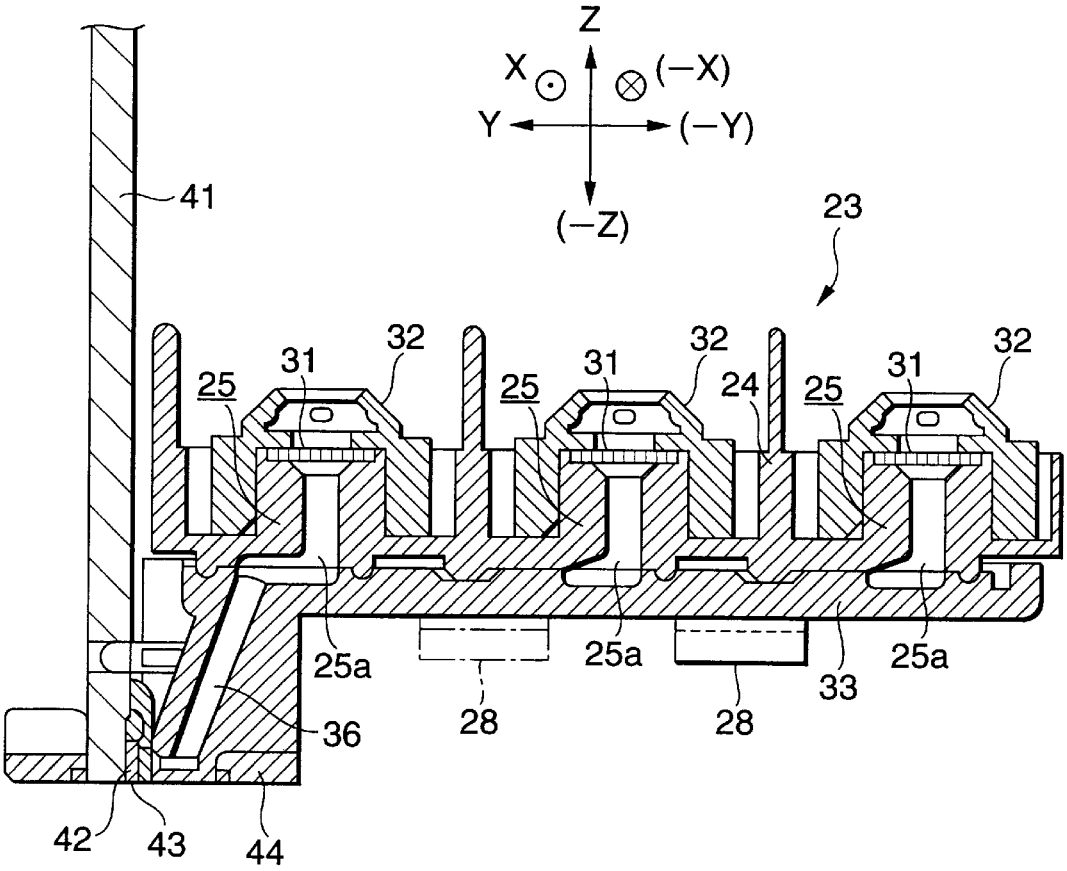
FIG. 5 is a front cross-sectional view of a print head in the first embodiment.
Figure 6A:
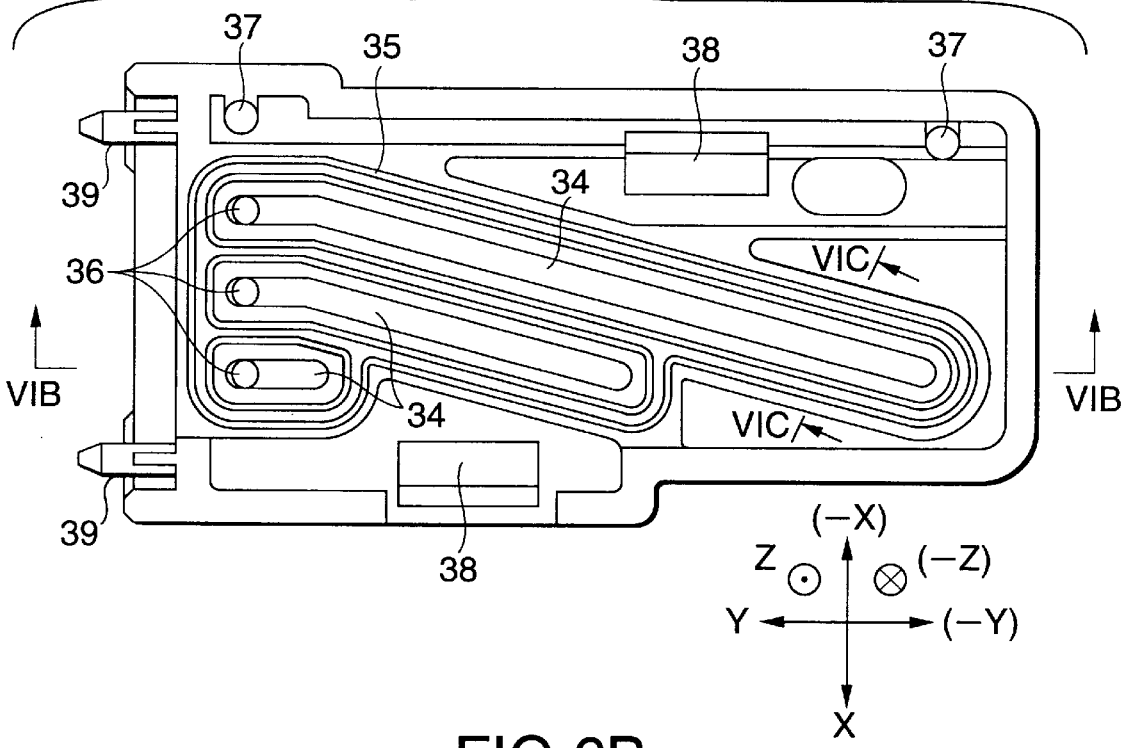
Figure 6B:
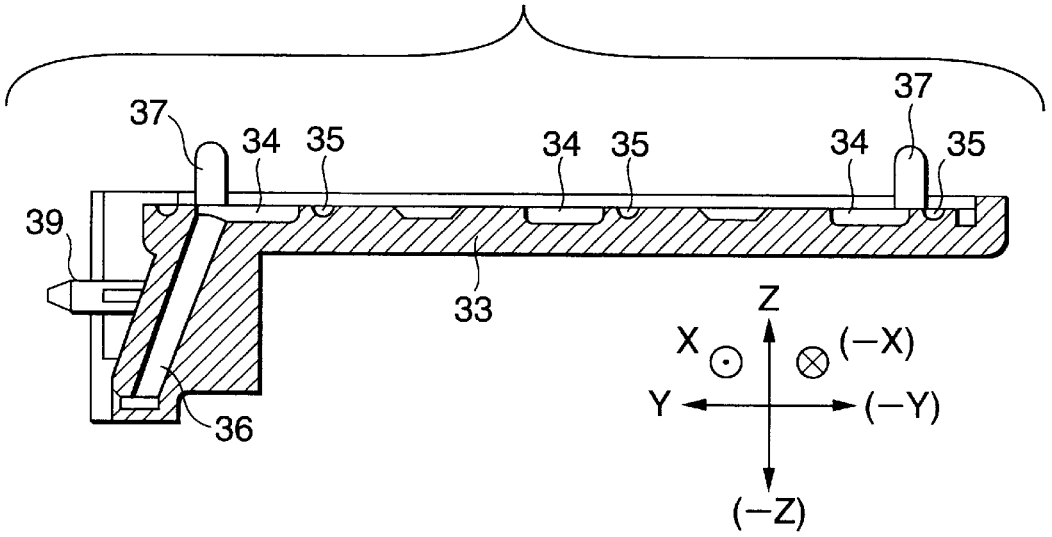
Figure 6C:
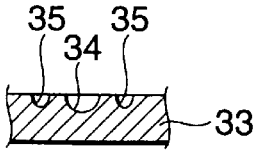
Figure 7A:
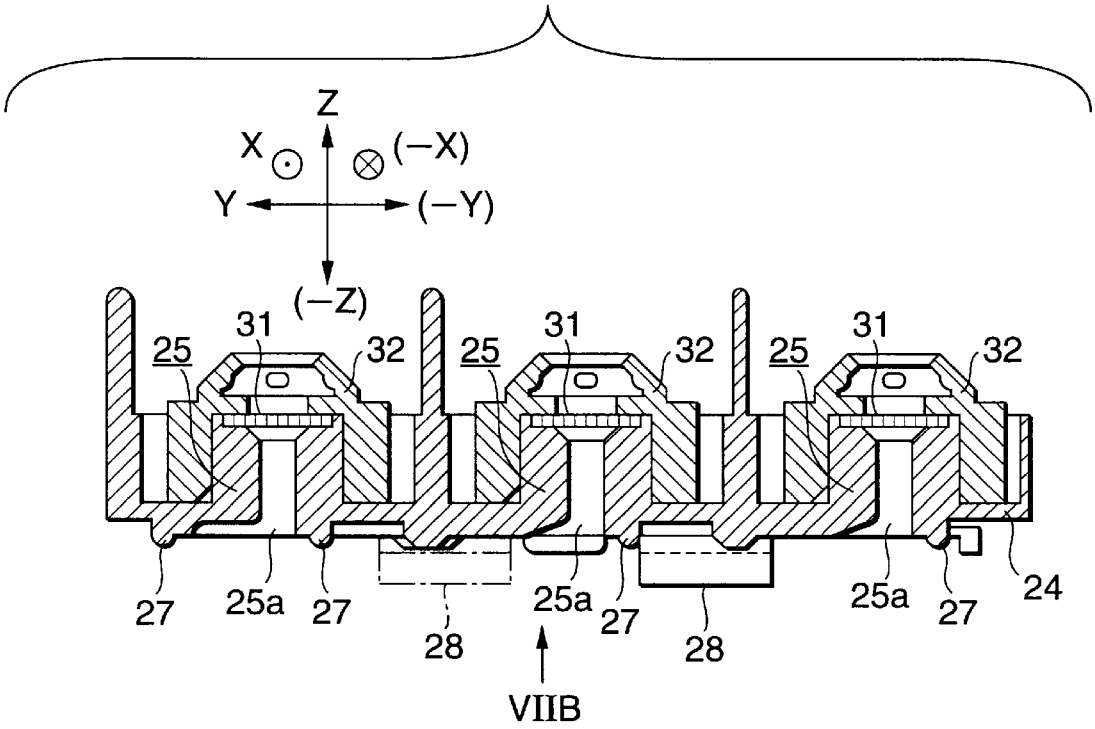
Figure 7B:
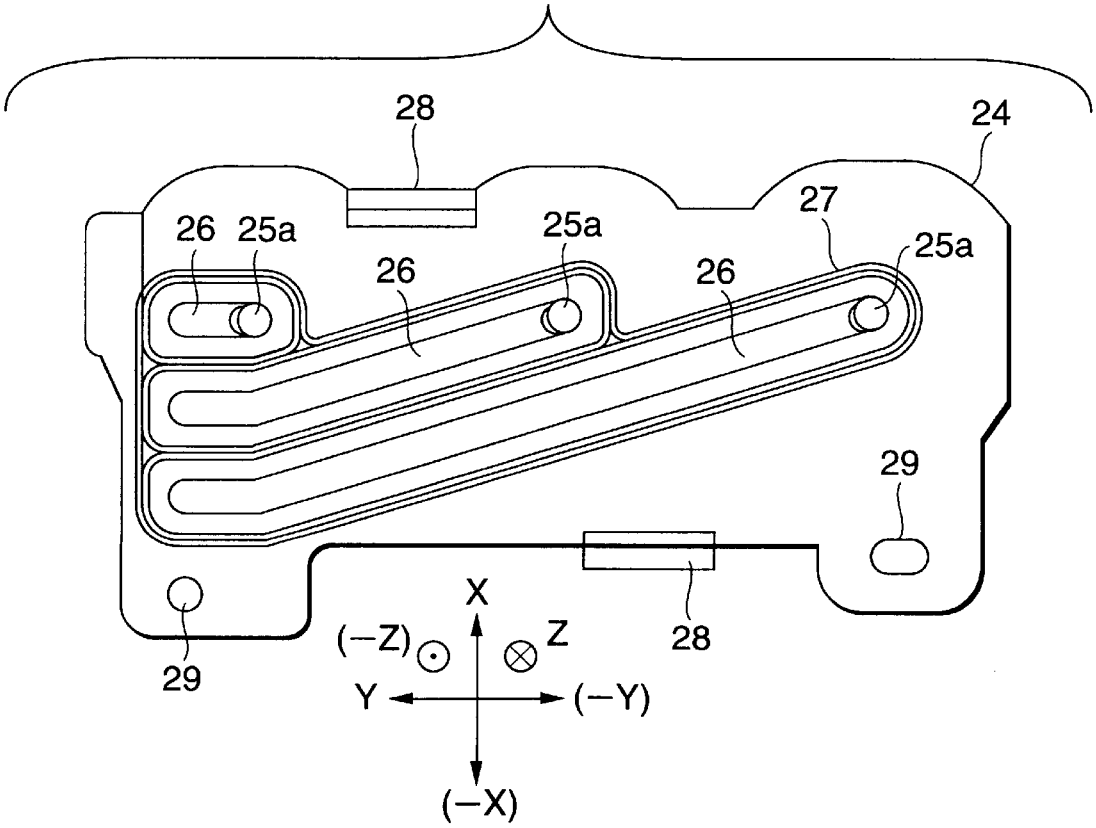
Figure 8:
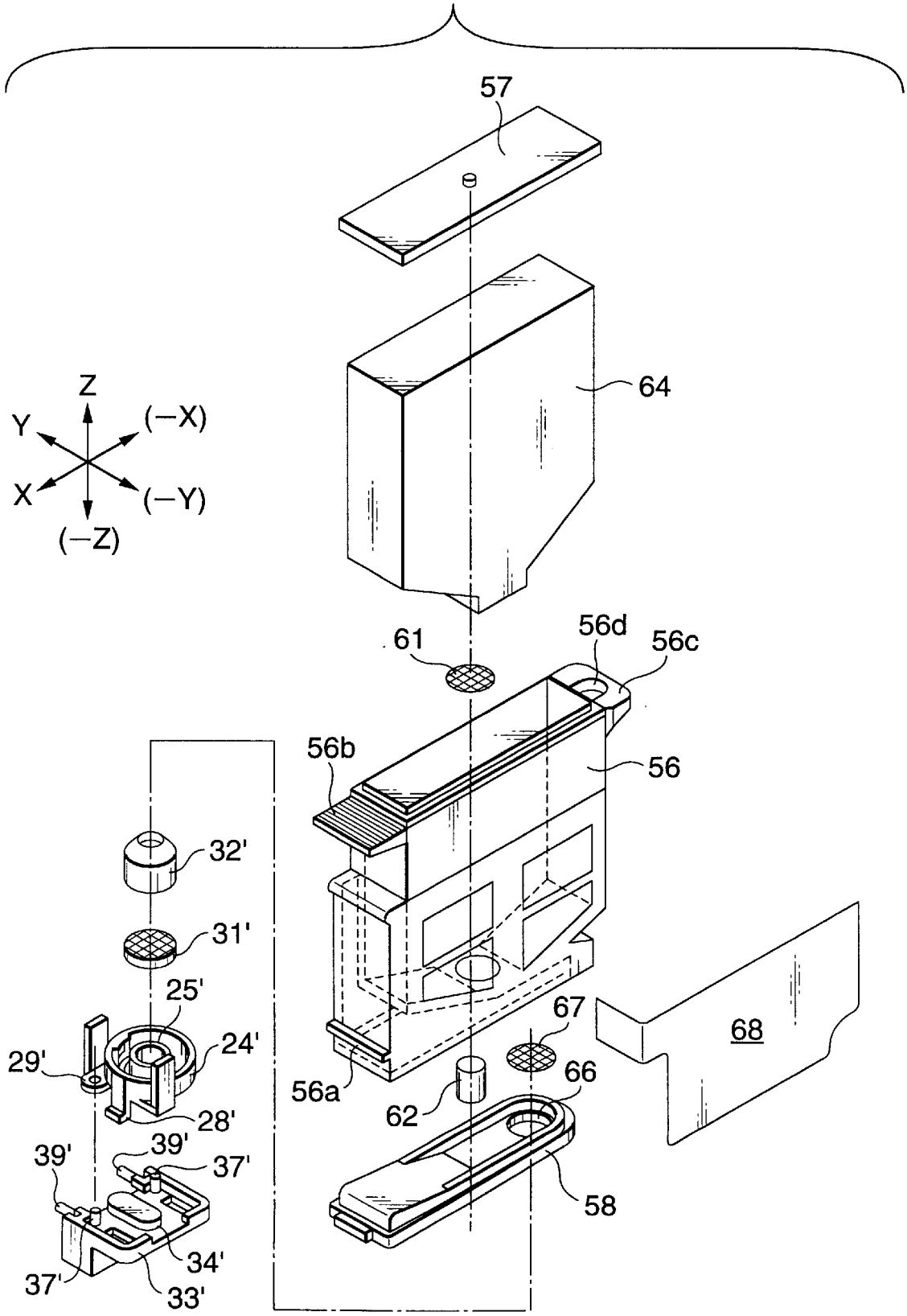
FIG. 8 is an exploded perspective view of a black ink tank and a print head for black in the first embodiment.
Figure 9A:
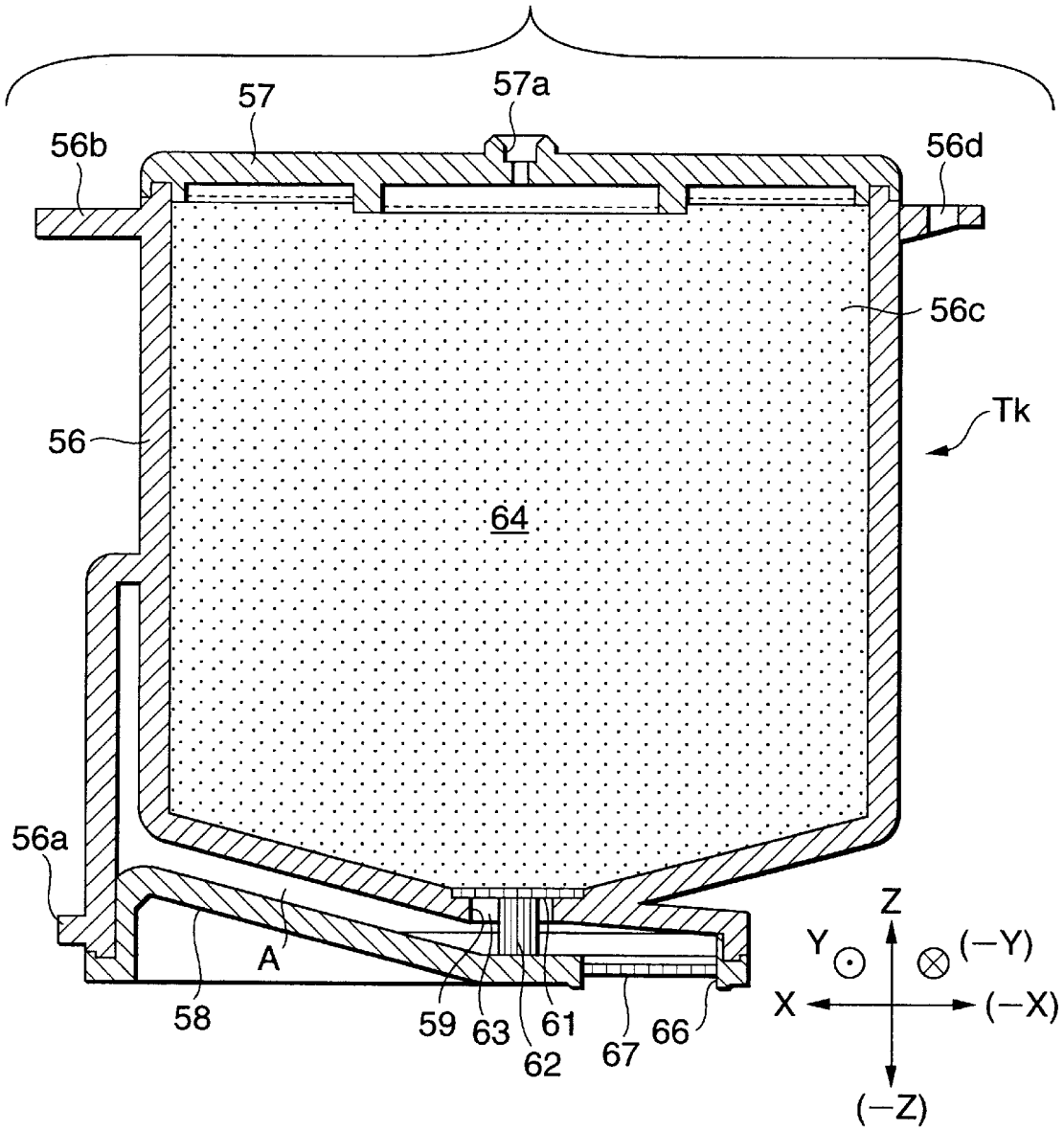
FIGS. 9A and 9B are detailed explanatory diagrams of the ink tank.
Figure 9B:
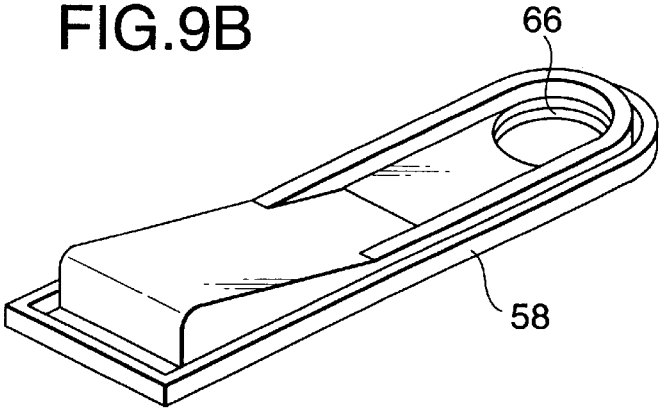

FIG. 1 is a schematic front cross-sectional view of a first embodiment of an ink jet printer in accordance with the present invention. FIG. 2 is a perspective view of a head carriage for supporting and carrying a print head unit which is used in the first embodiment. FIG. 3 is an exploded perspective view of the print head unit of the first embodiment. FIG. 4 is a front cross-sectional view of the print head unit in the first embodiment. FIG. 5 is a front cross-sectional view of a print head in the first embodiment. FIG. 6 is a diagram explaining an ink-channel forming member of the print head in the first embodiment, in which FIG. 6A is a top view, FIG. 6B is a cross-sectional view taken along line VIB—VIB of FIG. 6A, and FIG. 6C is a cross-sectional view taken along line VIC—VIC of FIG. 6A. FIG. 7 is a diagram explaining an ink-tank mounting member of the print head in the first embodiment, in which FIG. 7A is a front cross-sectional view, and FIG. 7B is a view (bottom view) taken in the direction of arrow VIIB in FIG. 7A. FIG. 8 is an exploded perspective view of a black ink tank and a print head for black in the first embodiment. FIG. 9 is a detailed explanatory diagram of the ink tank. FIG. 10 is a diagram explaining a method of mounting the ink tank in the head carriage and the print head unit. FIG. 11 is a diagram explaining the printing position of the ink droplet on the printing surface during the advance and return strokes of the print head unit H. FIG. 12 is a diagram explaining the printing timings in the first embodiment, and is an explanatory diagram in a case where the time durations until the ink droplets ejected from different head chips reach the printing surface are set to be identical. FIG. 13 is a diagram explaining the printing timings in a second embodiment, and is an explanatory diagram in a case where the time durations until the ink droplets ejected from different head chips reach the printing surface are set to be different.

In FIG. 1, an ink tank Tk for black (K) and ink tanks Ty, Tm, and Tc for yellow (Y), magenta (M), and cyan (C) are mounted on a print head unit H of the ink jet printer.

In FIG. 2, a head carriage C is a member which is reciprocatingly driven to the left and the right with the print head unit H mounted thereon, and the head carriage C has a carriage body 1 which is integrally molded from a resin. The carriage body 1 has a bottom wall 2, a left side wall 3, a right side wall 4, and an upper wall 5.

The bottom wall 2 is provided with a tank-supporting surface 2*a* at its front (X-side portion) and four resilient tank-front-end retaining members 2*b*. Further, a head-unit supporting surface 2*c* is provided at the rear of the bottom wall 2. A head-unit mounting opening 2*d* is formed in the head-unit supporting surface 2*c*.

Head-unit pressing projections 3*a* and 3*b* are provided on the inner surface of the left side wall 3. Meanwhile, a head-unit pressing projection 4*a* is provided on the inner surface of the right side wall 4.

Four resilient tank-rear-end retaining members 5*a* are provided at a free end on the front side of the upper wall 5 along the Y-axis direction (left-and-right direction).

A lower rear end of the head carriage C is supported by a guide rod R in such a manner as to be slidable in the left-and-right direction, and a belt-connecting member 6 provided at a lower front end of the head carriage C is connected to a timing belt B for the traversing of the carriage. The timing belt B is arranged to be reciprocated in the left-and-right direction by means of a motor, pulleys and the like which are not shown. Also, the head carriage C is moved in a sliding manner in the left-and-right direction along the guide rod R in correspondence with the reciprocating movement of the timing belt B.

The head carriage C has a connecting-substrate mounting portion 7 on the rear surface of the carriage body 1. A connecting substrate 8 having connectors 8*a* and 8*b* for connection to a connector substrate of the print head unit H which will be described later is arranged to be detachably mounted on the connecting-substrate mounting portion 7. A flexible cable 9 is connected to the connectors 8*a* and 8*b*, and image data for printing from an unillustrated image processing circuit is transmitted via the flexible cable 9.

In FIGS. 1, 3, and 4, the print head unit H which is mounted on the head carriage C has a housing 11. The housing 11 has a black ink print-head mounting portion 12 (see FIG. 3) at its left end portion. The black ink print-head mounting portion 12 has a head substrate front-end supporting portion 13, a head substrate rear-portion supporting groove 14, and a head mounting hole 15. The head substrate rear-portion supporting groove 14 has a lower-end supporting groove 14*a*, and a rear-edge supporting groove 14*b*.

In addition, the housing 11 of the print head unit H has a color ink print-head mounting portion 16 at its right side portion. The color ink print-head mounting portion 16 has a head substrate front-end supporting portion 17, a head substrate rear-portion supporting groove 18, and a head mounting hole 19. The head substrate rear-portion supporting groove 18 has a lower-end supporting groove 18*a* and a rear-edge supporting groove 18*b*.

Projections 21*a* and 21*b* for being supported (see FIG. 4) are provided on the left outer side of the housing 11, while a projection 21*c* for being supported is provided on the right outer side of the housing 11. In a state in which the print head unit H is mounted on the head carriage C, the projections 21*a* and 21*c* for being supported and the lower surface of the rear portion of the housing 11 are supported on the head-unit supporting surface 2*c* (see FIG. 2) of the head carriage C.

In a case where the print head unit H is mounted on the head carriage C, a lower portion of the housing 11 of the print head unit H is inserted in the head-unit mounting opening 2d of the head carriage C, and the projections 21*a* and 21*c* for being supported and the lower end of the rear portion of the housing 11 are supported on the head-unit supporting surface 2*c* of the head carriage C. In this state, if the print head unit H is slidingly moved in the backward direction, the projections 21*a*, 21*b*, and 21*c* for being supported are respectively pressed downward by the head-unit pressing projections 3*a*, 3*b*, and 4*a* (see FIG. 2).

A print head 23 for color ink (see FIG. 5) which is mounted in the color ink print-head mounting portion 16 on the right-hand side of the housing 11 has an ink-tank mounting member 24 for color ink. In FIGS. 3, 5, and 7, the ink-tank mounting member 24 has three hollow cylindrical portions 25 for forming ink inlet channels. An ink inlet channel 25*a* is formed in each of the hollow cylindrical portions 25 for forming ink inlet channels. The ink inlet channels 25*a* are channels through which ink of the respective colors, yellow (Y), magenta (M), and cyan (C) flows in.

In FIG. 7B, three channel-forming grooves 26 are formed on the lower surface of the ink-tank mounting member 24. The channel-forming grooves 26 are connected to the respective ink inlet channels 25*a*. A protrusion 27 surrounding each channel-forming groove 26 is formed around each channel-forming groove 26.

In addition, the ink-tank mounting member 24 is provided with two resilient projecting pieces 28 for retention which project downward. Further, two connecting holes 29 are formed in the ink-tank mounting member 24.

A circular plate-shaped filter 31 is disposed at an upper end of each of the hollow cylindrical portions 25 for forming ink inlet channels, and a hollow cylindrical resilient member 32 is disposed around each of the hollow cylindrical portions 25 for forming ink inlet channels.

As shown in FIG. 6, channel-forming grooves 34 are respectively formed on an upper surface of an ink-channel forming member 33, which is connected to the lower surface of the ink-tank mounting member 24, at positions opposing the three channel-forming grooves 26 (see FIG. 7B) on the lower surface of the ink-tank mounting member 24. A small concave groove 35 surrounding each channel-forming groove 34 is formed around each channel-forming groove 34, as shown in FIG. 6.

The protrusion 27 (see FIG. 7) is fitted in the concave groove 35, and is so arranged that ink does not leak from the ink channels formed by the channel-forming grooves 26 and 34. A head-communicating hole 36 is formed at a left end of each ink channel (26+34) formed by the channel-forming concave grooves 26 and 34.

In addition, two connecting projections 37 (see FIGS. 6A and 6B) are provided on the upper surface of the ink-channel forming member 33. These connecting projections 37 are projections which are respectively fitted in the connecting holes 29 (see FIG. 7B) in the ink-tank mounting member 24. Further, two retaining holes 38 (see FIG. 6A) are formed in the ink-channel forming member 33, and these retaining holes 38 are holes through which the projecting pieces 28 for retention (see FIG. 7) of the ink-tank mounting member 24 are passed and are retained.

Substrate-connecting projections 39 (see FIG. 6A) are provided on a left side surface of the ink-channel forming member 33.

A positioning projection 42 is formed on a front end surface of a head substrate 41 which is connected to the ink-channel forming member 33 by means of holes (see FIG. 3) to which the substrate-connecting projections 39 are fitted. Further, printed wiring is formed on the head substrate 41, and an IC, a head chip 43, and the like are mounted thereon. A plurality of nozzles (not shown) for projecting ink are formed at a lower end 43*a* of the head chip 43. Ink is arranged to be supplied from the head-communicating holes 36 to the unillustrated nozzles. It should be noted that, as for the arrangements of the head substrate 41 and the head chip 43, it is possible to adopt various arrangements which are conventionally known.

Outer peripheral portions of lower ends of the head substrate 41 and the ink-channel forming member 33 are connected together by being fitted in a hole 44*a* (see FIG. 3) of a connecting frame member 44.

The print head 23 for color ink is constituted by the elements denoted by the reference numerals 24 to 44.

In FIG. 4, the head chip 43, the connecting frame 44, and the like of the print head 23 for color ink are passed through the head-mounting hole 19 in the housing 11 (see FIG. 3) from above to below, and are disposed below the lower surface of the housing 11. Further, the positioning projection 42 of the head substrate 41 and its rear end are positioned and supported by the head substrate front-end supporting portion 17 and the head substrate rear-portion supporting groove 18 of the housing 11.

As shown in FIG. 4, a positioning member 46 having a U-shaped cross section is fitted between the rear-edge supporting groove 18*b* and an, upper end of a rear side of the head substrate 41 which is fitted in the rear-edge supporting groove 18*b* of the head substrate rear-portion supporting groove 18, and the upper end of the head substrate 41 is thereby fixed to the housing 11. The lower surface of the ink-channel forming member 33 of the print head 23 for color ink is bonded to the upper surface of the bottom wall of the housing 11.

While the above-described print head 23 for color ink is arranged to eject ink of three colors, yellow (Y), magenta (M), and cyan (C), a print head 23' for black ink which is mounted in the black ink print-head mounting portion 12 at the left end portion of the housing 11 is arranged to eject ink of only one color of black. The print head 23' for black ink has constituent elements similar to those of the print head 23 for color ink, so that the constituent elements of the print head 23' which correspond to the constituent elements of the print head 23 for color ink will be denoted by the same reference numerals to which primes (') are appended.

Accordingly, as shown in FIGS. 3, 4, and 8, the print head 23' for black ink has an ink-tank mounting member 24', a circular plate-shaped filter 31', a hollow cylindrical resilient member 32', an ink-channel forming member 33', a head substrate 41', and a connecting frame 44'.

Thus the print head 23' for black ink is constituted by elements denoted by the reference numerals 24' to 44'.

In FIG. 4, the head chip 43', the connecting frame 44', and the like of the print head 23' for black ink are passed through the head-mounting hole 15 in the housing 11 (see FIG. 3) from above to below, and are disposed below the lower surface of the housing 11. Further, a positioning projection 42' of the head substrate 41' and its rear end are positioned and supported by the head substrate front-end supporting portion 13 and the head substrate rear-portion supporting groove 14 of the housing 11.

As shown in FIG. 4, a positioning member 46' having a U-shaped cross section is fitted between the rear-edge supporting groove 14*b* and an upper end of a rear side of the head substrate 41' which is fitted in the rear-edge supporting groove 14*b* of the head substrate rear-portion supporting groove 14, and the upper end of the rear side of the head substrate 41' is thereby fixed to the housing 11. The lower surface of the ink-channel forming member 33' of the print head 23' for black ink is bonded to the upper surface of the bottom wall of the housing 11'.

In FIG. 4, the position of a lower end 43*a*' (the position where ejection holes of black-ink ejecting nozzles are formed) of the head chip 43' of the print head 23' for black ink fixed to the housing 11 is set Δh higher than the position of the lower end 43*a* (the position where ejection holes of the color-ink ejecting nozzles are formed) of the head chip 43 of the print head 23 for color ink fixed to the housing 11.

Accordingly, in FIG. 1, if it is assumed that the distance from the printing surface to the lower end 43*a* (the position where the ejection holes of the color-ink ejecting nozzles are formed) is h1, and that the distance from the printing surface to the lower end 43*a*' (the position where the ejection holes of the black-ink ejecting nozzles are formed) is h2, then h2=h1+Δh.

In FIG. 3, a connector substrate 47 which is mounted on the rear surface of the housing 11 has a pair of left and right retaining pawls 48 which project in the forward direction (X-direction). The retaining pawls 48 are respectively arranged to engage a pair of retaining holes 11*a* (see FIG. 4) which are formed in a rear wall (not shown) provided at left and right end portions of the rear surface of the housing 11. The connector substrate 47 is arranged to be mounted on the housing 11 by means of the retaining pawls 48 which engage the retaining holes 11*a* (see FIG. 4).

Two connectors 49 and 49' are provided on the front surface of the connector substrate 47. A cable 50 for connection to the head substrate 41 for color ink is detachably connected to the connector 49 disposed on the right-hand side, while a cable 50' for connection to the head substrate 41' for black ink is detachably connected to the connector 49' disposed on the left-hand side.

The print head unit H in this embodiment is constituted by the elements denoted by the reference numerals 11 to 50 and the like.

In FIGS. 1 and 3, the ink tank Tk for black (K) and the ink tanks Ty, Tm, and Tc for yellow (Y), magenta (M), and cyan (C) are used to supply ink to the print head unit H. As can be appreciated from FIG. 1, the ink tanks Ty, Tm, and Tc for color are of the same size, but the ink tank Tk for black is slightly wider than the other ink tanks Ty, Tm, and Tc. However, since the ink tanks Ty, Tm, Tc, and Tk are arranged similarly in the other aspects, the ink tank Tk for black will be described with reference to FIGS. 8 and 9.

In FIGS. 8 and 9, the ink tank Tk has a tank body 56, a lid 57 for closing an upper opening of the tank body 56, and a double-bottom-wall forming member 58 which is fitted to a lower end of the tank body 56.

A front-side projection 56*a* for retention is provided on a lower portion of the front-side surface of the tank body 56, and a knob 56*b* is provided on an upper portion of the front-side surface. Further, a rear-side projecting piece 56*c* for retention is provided on an upper portion of the rear-side surface of the tank body 56. A hole 56*d* for retention is provided in the rear-side projecting piece 56*c*.

An auxiliary ink chamber A (see FIG. 9) is formed between the lower surface of the tank body 56 and the double-bottom-wall forming member 58.

A hole 59 communicating with the auxiliary ink chamber A is formed at a lower end of the inner surface of the tank body 56, and a meniscus-forming member 61 is provided at an upper end of the hole 59. A wick 62 for constantly wetting the meniscus-forming member 61 is disposed so as to secure a space portion 63 and come into contact with a bottom surface at a lowermost end of the auxiliary ink chamber A.

An ink-impregnated member 64 which is impregnated with ink is disposed in the tank body 56 (main ink chamber), and an atmosphere-communicating port 57*a* for communicating with the atmosphere is formed in the lid 57. The lid 57 is disposed in spaced-apart relation to an upper surface of the ink-impregnated member 64 so as not to compress the ink-impregnated member 64. A meniscus-forming member 67 for preventing ink leakage from the auxiliary ink chamber A is disposed at an ink-supplying port 66 which is formed in a lower end of the double-bottom-wall forming member 58.

In addition, a seal 68 (see FIG. 8) for displaying the color of the ink and the like is attached to the right-hand surface of the tank body 56.

The ink tank Tk for black ink is constituted by the elements denoted by the reference numerals 56 to 68. The ink tanks Ty, Tm, and Tc for other colors are arranged similarly except that their widths are slightly smaller.

Operation of First Embodiment

Next, a description will be given of the embodiment of the ink jet printer of the present invention which is provided with the above-described arrangements.

The print head unit H constituted by the elements denoted by the reference numerals 11 to 50 is mounted on the carriage C in the operating procedure which will be described below. Namely, the lower portion of the housing 11 of the print head unit H is inserted in the head-unit mounting opening 2*d* of the head carriage C, and the projections 21*a* and 21*c* for being supported and the lower end of the rear portion of the housing 11 are supported on the head-unit supporting surface 2*c* of the head carriage C. In this state, if the print head unit H is slidingly moved in the backward direction, the projections 21*a*, 21*b*, and 21*c* for being supported, which are shown in FIGS. 3 and 4, are respectively pressed downward by the head-unit pressing projections 3*a*, 3*b*, and 4*a*, which are shown in FIGS. 2. The print head unit H is then secured on the head carriage C.

Figure 10A:
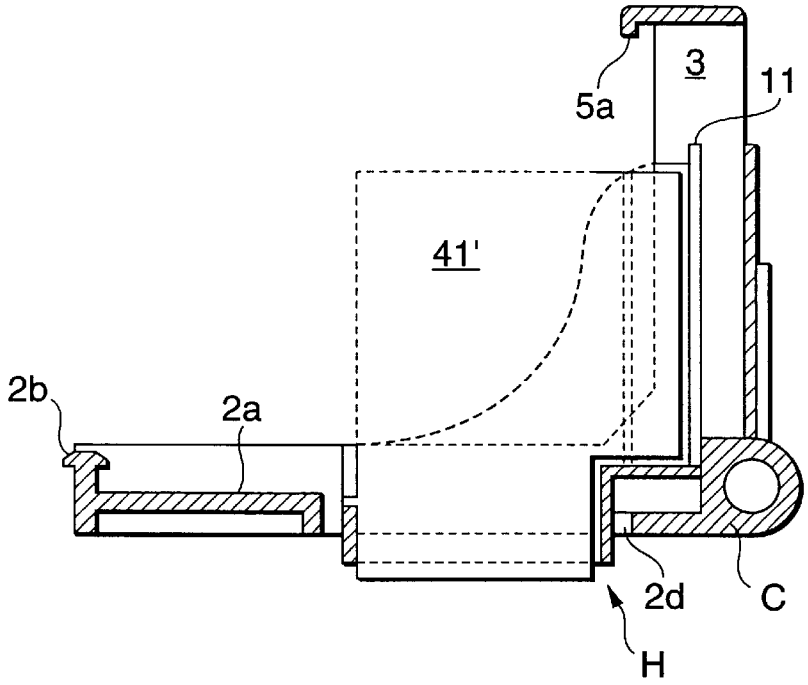
FIGS. 10A and 10B are diagrams explaining a method of mounting the ink tank in the head carriage and the print head unit.

Cross-sectional views of the print head unit H and the head carriage C in this state are shown in FIG. 10A.

Figure 10B:
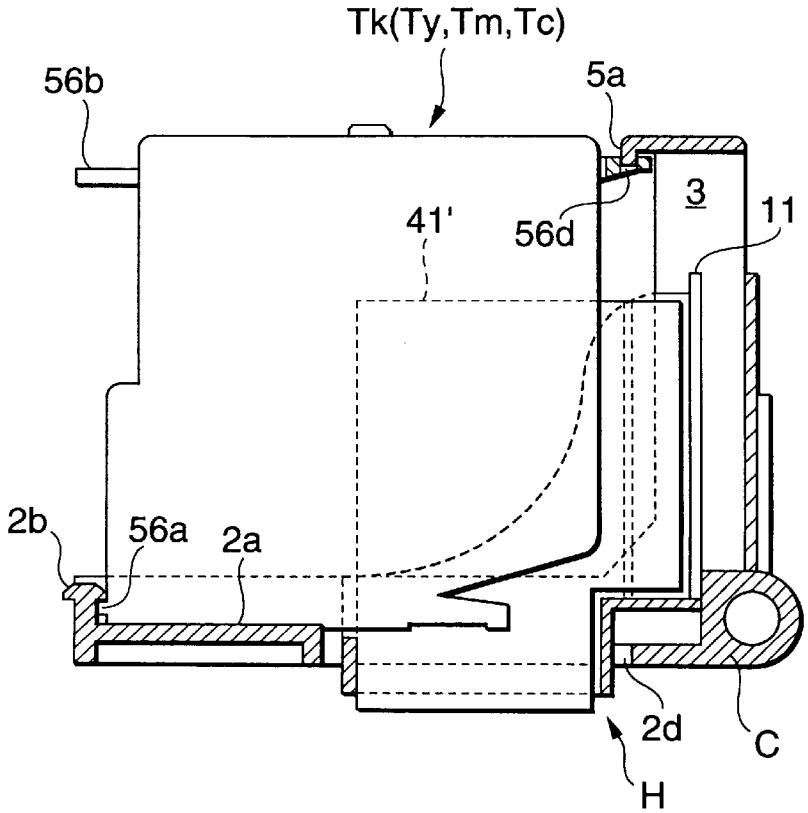

In the state of FIG. 10A, the ink tank Tk is mounted in the print head unit H and the head carriage C, and the state shown in FIG. 10B is thereby obtained. Namely, the front end projection 56*a* of the ink tank Tk is retained at the tank-front-end retaining members 2*b* (see FIG. 2), and the rear-side projecting piece 56*c* is retained at the tank-rear-end retaining members 5*a*. As for the method of mounting the ink tank Tk in this case, the lower surface of the front end of the ink tank Tk is allowed to be supported on the upper surface of the tank-front-end retaining members 2*b* (see FIG. 2), and the rear end of the ink tank Tk is inclined downward to cause the rear-side projecting piece 56*c* to be placed below the tank-rear-end retaining members 5*a*. In this state, if the lower surface of the front end of the ink tank Tk is slid downward along the surfaces of the tank-front-end retaining members 2*b*, the front end of the ink tank Tk moves downward, and the rear end thereof moves upward, and the state shown in FIG. 10B is obtained.

In this manner, the print head unit H and the ink tank Tk are mounted on the head carriage C. The mounting of the ink tanks Ty, Tm, and Tc for color ink is similar to the above-described case of the ink tank Tk.

In the print head unit H mounted on the head carriage in the above-described manner, the position of the lower end 43*a* (the position where the ejection holes of the color-ink ejecting nozzles are formed) of the head chip 43, shown in FIG. 4, of the print head 23 for color ink fixed to the housing 11, as well as the position of the lower end 43*a*' (the position where the ejection holes of the black-ink ejecting nozzles are formed) of the head chip 43' of the print head 23' for black ink fixed to the housing 11, are respectively at the distances of h1 and h2 from the printing surface, as shown in FIG. 1. Incidentally, Δh shown in FIG. 4 is provided such that Δh=h2−h1.

FIG. 11 is a diagram illustrating the operation in a case where the print head unit H effects printing while traversing.

In the above-described print head unit H, in a stationary state, if it is assumed that the ink droplet velocity of the color ink is V1, that the distance between the paper surface and the distal end of the head chip 43 for color ink is h1, and that the time until the color ink droplet impacts against the paper surface is t1, then t1=h1/V1.

Similarly, if it is assumed that the ink droplet velocity of the black ink is V2, that the distance between the paper surface and the distal end of the head chip 43' for black ink is h2, and that the time until the black ink droplet impacts against the paper surface is t2, then t2=h2/V2.

In the print head unit H of this embodiment, V1 and V2 are not equal. Therefore, values of h1 and h2 are set such that t1=t2.

Namely, in this embodiment, the ejection velocity of color ink is set to 8.5 m/s, and the ejection velocity of black ink is set to 11.5 m/s. Further, the distance h1 between the paper surface and the head chip 43 for color ink is set to 1.5 mm. Accordingly, under these conditions, the distance h2 is set such that h2=h1×(V2/V1)=2.03 mm.

In this embodiment, printing is effected at 7 kHz at intervals of 300 dpi. In this case, the print dot interval ΔL becomes as follows:

$$\Delta L = 300\ dpi / 25.4\ \text{mm}$$
$$= 0.0845$$

The velocity V of the carriage C in this case becomes follows:

$$V = \Delta L \times 7000$$
$$= 0.0845\ \text{mm} \times 7000\ \text{Hz}$$
$$= 592.67\ \text{mm/sec}$$

Figure 11A:
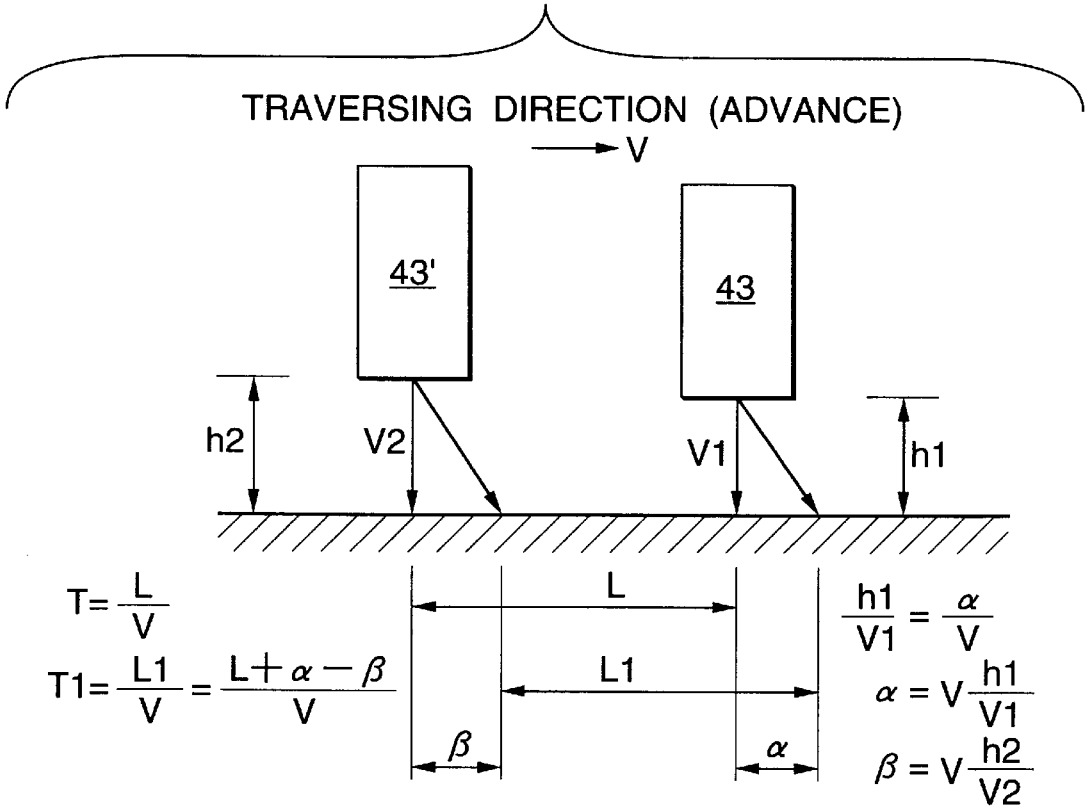
FIGS. 11A and 11B are diagrams explaining the printing position of the ink droplet on the printing surface during the advance and return stroke of the print head unit H.

In FIG. 11, it is assumed that the distance between the color-ink impact position and the black-ink impact position in a stationary state is L, and that the distance between the color-ink impact position and the black-ink impact position in the leftward traversing state shown in FIG. 11A is L1. Further, α in FIG. 11A denotes the distance between the color-ink ejecting position and its impact position along the printing surface, while β denotes the distance between the black-ink ejecting position and its impact position along the printing surface. In this case, $$\alpha = V \times (h1/V1)$$
$$\beta = V \times (h2/V2)$$

In this case, L1 becomes as follows:

$$L1 = L + \alpha - \beta$$
$$= L + 592.67 \times (hi / V1 - h2 / V2)$$

Figure 11B:
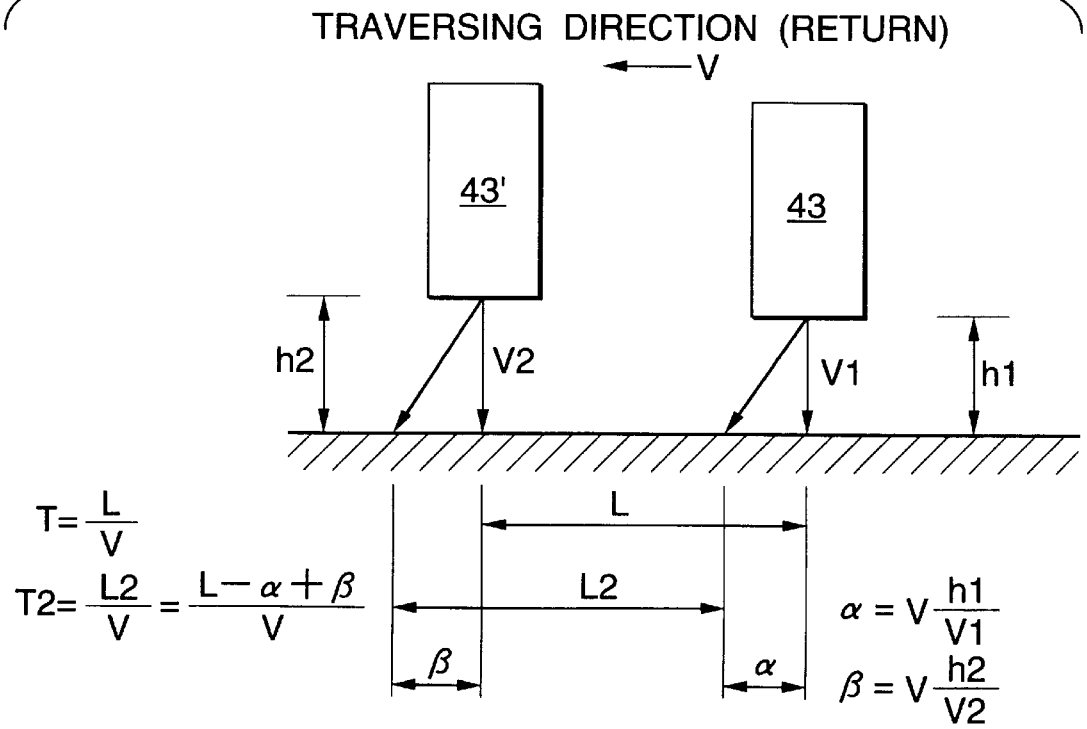
Figure 12A:
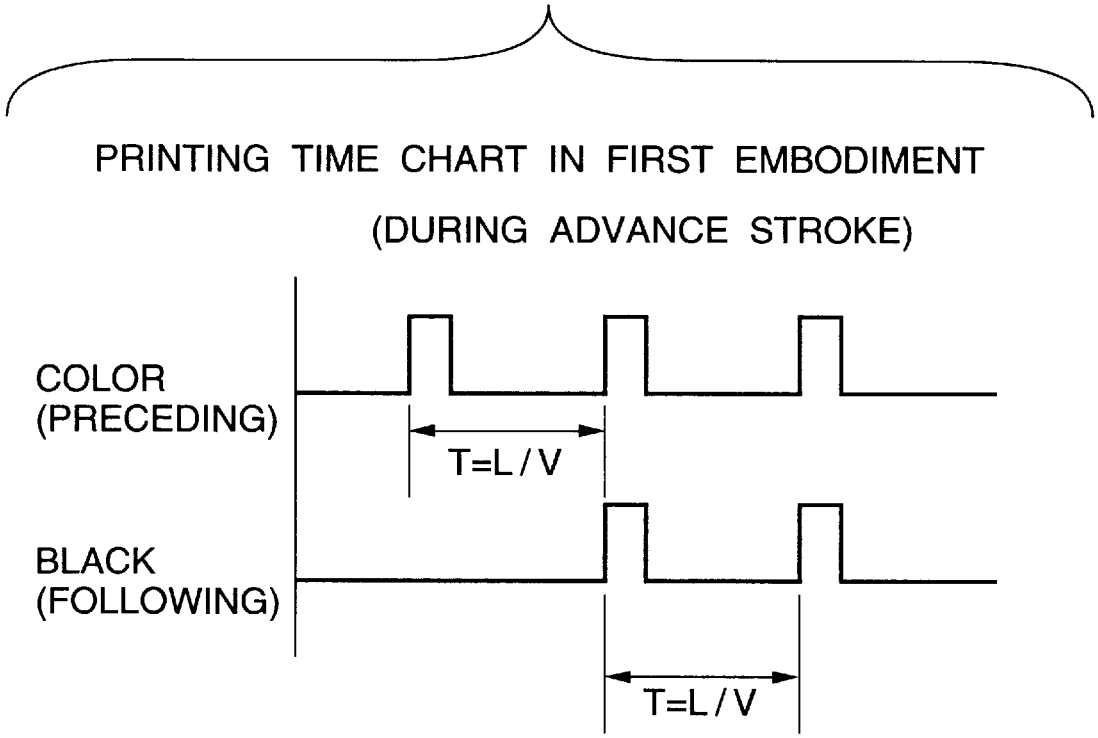
FIGS. 12A and 12B are diagrams explaining the printing timings in the first embodiment, and are explanatory diagrams in a case where the time durations until the ink droplets ejected from different head chips reach the printing surface are set to be identical.
Figure 12B:
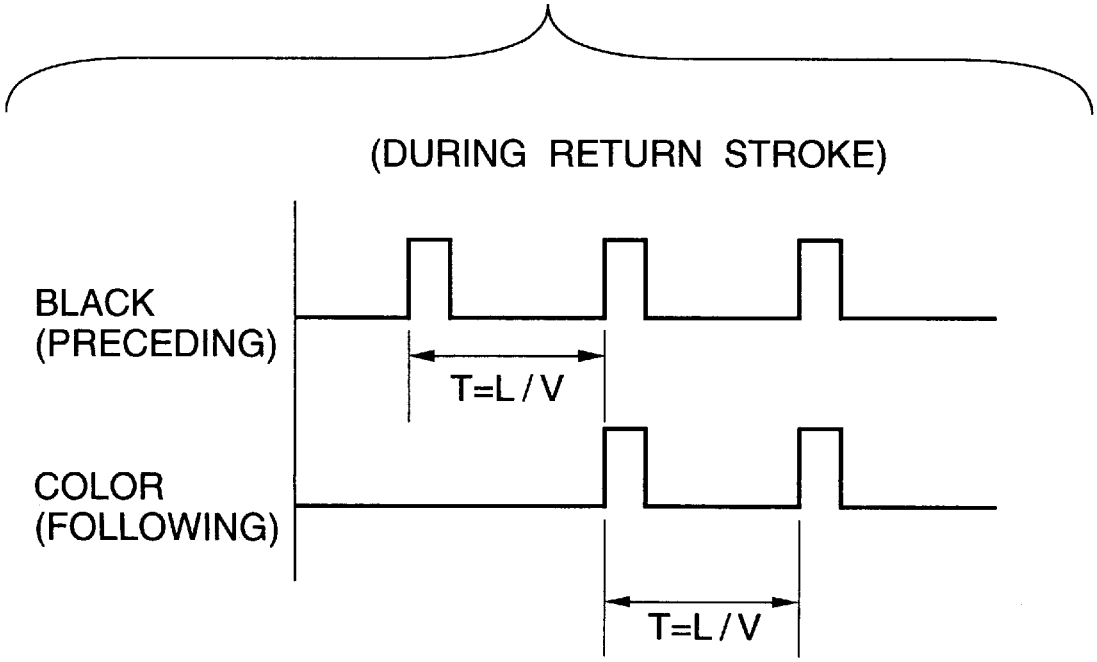

Next, in FIG. 11B, if it is assumed that the distance between the color-ink impact position and the black-ink impact position in the rightward traversing state is L2, then $$L2 = L + \beta - \alpha$$
$$= L + 592.67 \times (h2 / V2 - h1 / V1)$$

During both advance and return strokes, it is natural that a setting be provided such that L1=L2. In the above-described case, $$L2 - L1 = 2 \times (h2 / V2 - h1 / V1)$$
$$= 2(t2 - t1)$$

In this embodiment, V1, h1, V2, and h2 are provided such that t2−t1=0 as described above, so that L2−L1=0. In this case, L1=L2=L.

In this case, during the advance stroke, ink ejection by the head chip 43' for black ink is effected when the head chip 43 for color ink has moved by the distance L after ejecting the color ink, whereas, during the return stroke, ink ejection by the head chip 43 for color ink is effected when the head chip 43' for black ink has moved by the distance L after ejecting the black ink, thereby making it possible to effect printing with the black ink and the color ink without positional offset.

The time T required for the head chips 43 and 43' to move by the distance L can be expressed by $$T = L/V$$

In this case, as shown in FIG. 12, the order of printing by the head chips 43 and 43' is reversed between the advance stroke and the return stroke, but since the ink ejection by a later head chip is effected with a lag of the time T, the printing with the black ink and the color ink can be effected without positional offset.

Second Embodiment

In the ink jet printer in accordance with the second embodiment of the present invention, in FIG. 11, if it is assumed that the moving velocity of the print head unit H is V, that the distance from the printing surface to the lower end 43*a* (the position where the ejection holes of the color-ink ejecting nozzles are formed) of the head chip 43 for color ink in the case where the head chips 43 and 43' are disposed at the distance L in the moving direction is hi, that the ink droplet ejection velocity of the color ink is V1, that the distance from the printing surface to the lower end 43*a*' (the position where the ejection holes of the black-ink ejecting nozzles are formed) of the head chip 43' for black ink is h2, and that the ink droplet ejection velocity of the-black ink is V2, then a setting is provided such that h1=h2, V1<V2, hence, t1 (=h1/V1)<t2 (=h2/V2). In this case, $\alpha<\beta$, and L1<L<L2.

In this case, an ink-ejection controlling device provided for controlling the ink ejection timing is arranged such that in a case where the head chip 43 having a shorter ink-droplet reaching time duration t1 (=h1/V1) precedes as shown in FIG. 11A, the ink-ejection controlling device delays the ink-droplet ejection timing of the following head chip 43' by (L1/V)=(L+$\alpha$−$\beta$)/V as compared to the preceding head chip 43. On the other hand, in a case where the head chip 43' having a longer ink-droplet reaching time duration t2 (=h2/V2) precedes as shown in FIG. 11B, the ink-ejection controlling device delays the ejection timing of the following head chip 43 by (L2/V)=(L−$\alpha$+$\beta$)/V.

Operation of Second Embodiment

During the advance stroke shown in FIG. 11A, when the time T=(L/V) elapses after printing (ink ejection) by the preceding head chip 43 disposed at a forward position in the moving direction, the following head chip 43' moves to the same position as the printing position of the head chip 43. At the same position, when the head chip 43' effects printing (ink ejection), the impact position of the ink droplet on the printing surface is offset by ($\beta$−$\alpha$). To ensure that this positional offset does not occur, it suffices if the head chip 43' effects printing (ink ejection) at a point of time when a time T1=(L1/V) has elapsed after the printing (ink ejection) by the head chip 43.

In other words, if the head chip 43' effects printing (ink ejection) at the point of time when the time T1=(L1/V) =(L+$\alpha$−$\beta$)/V has elapsed after the printing (ink ejection) by the head chip 43, it is possible to prevent the positional offset of the printing positions of the head chips 43 and 43'.

Similarly, during the return stroke shown in FIG. 11B, if the head chip 43' effects printing (ink ejection) at the point of time when the time T2=(L2/V)=(L−$\alpha$+$\beta$)/V has elapsed after the printing (ink ejection) by the head chip 43, it is possible to prevent the positional offset of the printing positions of the head chips 43 and 43'.

Figure 13A:
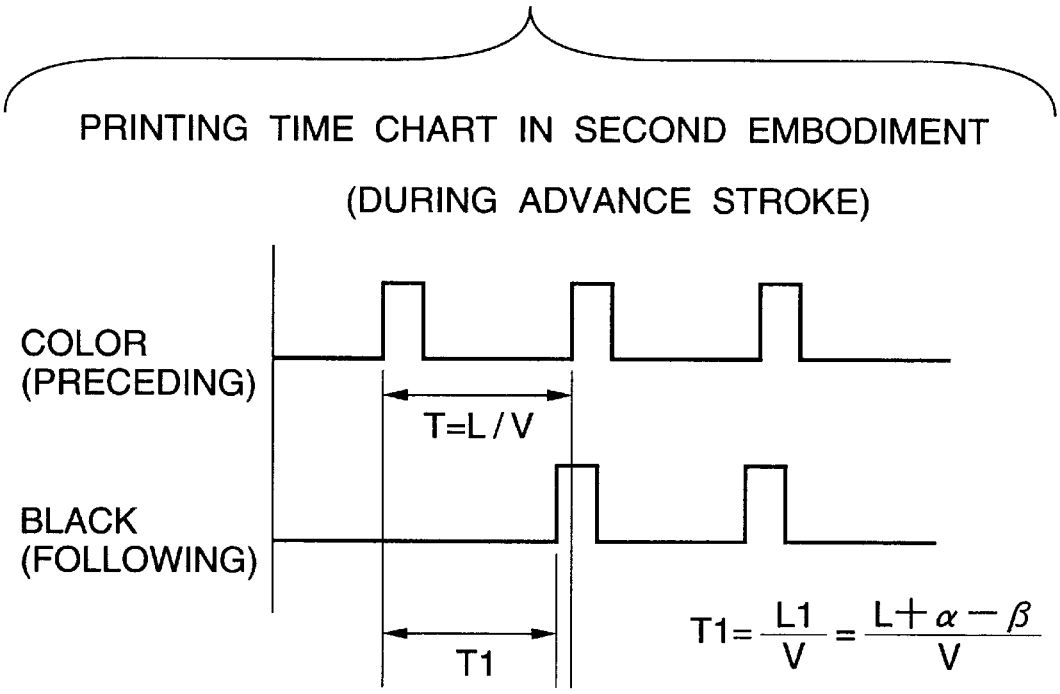
FIGS. 13A and 13B are diagrams explaining the printing timings in a second embodiment, and are explanatory diagrams in a case where the time durations until the ink droplets ejected from different head chips reach the printing surface are set to be different.
Figure 13B:
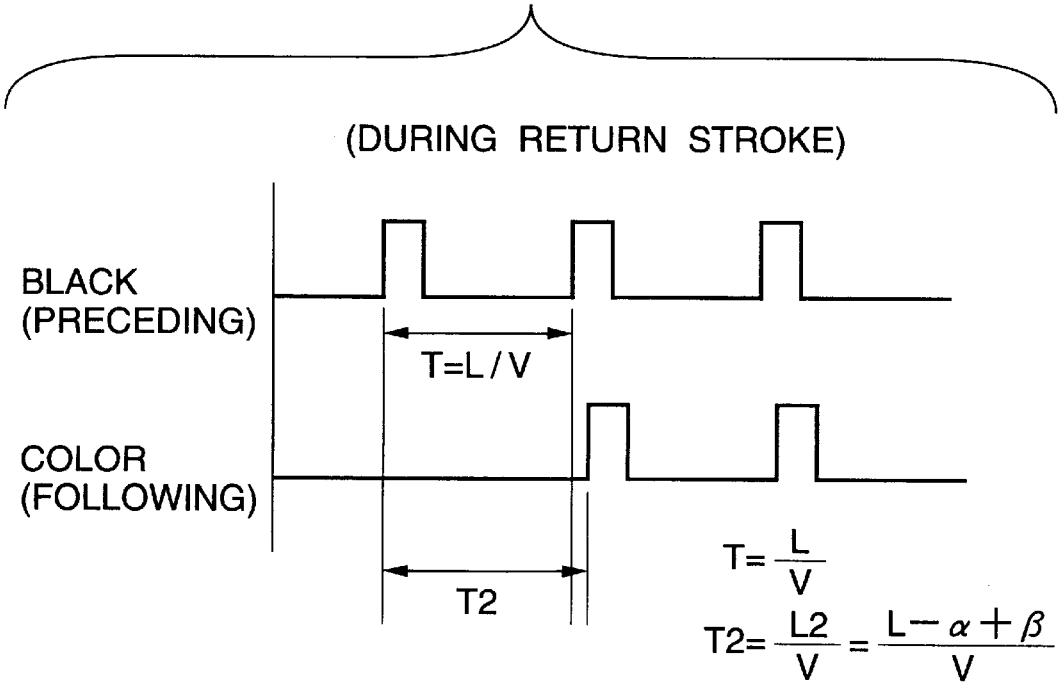

That is, in order to ensure that the positional offset of the print dot does not occur during the advance and return strokes of the head carriage C, it suffices if, as shown in FIG. 13, during the advance stroke (see FIG. 13A), the ink ejection by a following head chip is delayed by the time T1=(L1/V)=(L+$\alpha$−$\beta$)/V and, during the return stroke (see FIG. 13B), the ink ejection by a following head chip is delayed by a time T2=(L−$\alpha$+$\beta$)/V.

In addition, as can be seen from FIG. 11A, if $\alpha<\beta$, the time duration t1 (=h1/V1) from the time the ink droplet is ejected from the head chip 43 until it reaches the printing surface is shorter than the reaching time t2 (=h2/V2) of the ink droplet from the head chip 43'. Thus, the time lag T1 (the elapsed time from the ejection timing of a preceding head chip until the ejection timing of a following head chip with respect to the same printing position) in a case where the head chip 43 precedes whose time duration from the ejection timing of the ink droplet until reaching the printing surface is set to be short (see FIG. 11A) is set to be shorter than the time lag T2 in a case where the head chip 43 follows (the setting is provided such that T1<T2). Consequently, it is possible to reduce the positional offset of the impact positions of the ink droplets which are ejected from the head chips 43 and 43' disposed in mutually spaced-apart relation in the reciprocating direction.

Namely, as the time (time lag) by which the ink ejection by the head chip which ejects ink later is delayed is changed for the advance stroke and the return stroke, it is possible to reduce the positional offset of the ink droplets.

Modification

Although the embodiments of the present invention have been described above in detail, the present invention is not limited to the above-described embodiments, and various modifications are possible within the scope of the gist of the present invention stated in the claims.

(H01) The present invention may be applied to an ink-jet recording apparatus in which three or more print heads for printing while reciprocating are disposed in mutually spaced-apart relation in the moving direction.

The above-described invention offers the following advantage:

(E01) It is possible to ensure that color offset does not occur in a case where a plurality of print heads having different ejection velocities are used.

What is claimed is:

1. An ink jet printer, comprising:

a plurality of print heads respectively communicating with interiors of mutually different ink tanks, and each having an ink nozzle for ejecting ink accommodated in each of said ink tanks onto a printing surface, wherein said print heads are arranged such that a first position of a first ink nozzle operative to eject an ink droplet at a first velocity is disposed in a spaced apart relationship farther from the printing surface than a second position of a second ink nozzle operative to eject an ink droplet at a second velocity being less than the first velocity, so as to reduce time variations relative to when the ink droplets ejected from respective ones of the first and second ink nozzles reach the printing surface.

2. The ink jet printer of claim 1, wherein said print heads having ink nozzles respectively communicating with the interiors of said ink tanks accommodating black ink and color ink other than black, and said print heads arranged such the ink droplet velocity of the black ink is higher than the ink droplet velocity of the color ink, and said black-ink ejecting nozzle is disposed in such a manner as to be spaced apart farther from the printing surface than the position of said color-ink ejecting nozzle.

3. An ink jet printer, comprising:

a plurality of print heads respectively communicating with interiors of mutually different ink tanks, and each having an ink nozzle for ejecting ink accommodated in each of said ink tanks onto a printing surface, the plurality of print heads operative to reciprocally move in and print along a reciprocating direction, the ink nozzles disposed in a spaced apart relationship relative to each other in the reciprocating direction and arranged to have a leading ink nozzle and a following ink nozzle positioned behind the leading ink nozzle as the plurality of print heads reciprocally move in the reciprocating direction, wherein a selected one of said ink nozzles ejects an ink droplet in a shorter time duration measured from when the ink droplet is ejected until the ink droplet reaches the printing surface compared to a remaining one of said ink nozzles and the following ink nozzle ejects the ink droplet after a lapse of a predetermined time lag from an ejection timing of the leading ink nozzle, such that the ink droplet ejected from said following ink nozzle impacts an impact position of the ink droplet ejected from said leading ink nozzle during the reciprocating movement; and an ink-ejection controlling device operative to control ejection of the ink.

4. The ink jet printer of claim 3, wherein the ink-ejection controlling device controls the ejection of the ink based upon the predetermined time lag.

5. The ink jet printer of claim 4, wherein the reciprocating direction includes an advance direction component and a return direction component being opposite of the advance direction component and the predetermined time lag includes first time lag component and a second time lag component different from the first time lag component and wherein the ink-ejection controlling device is operative to control ejection of the ink based upon the first time lag component applied to the advance direction component and the second time lag component applied to the return direction component.

* * * * *